US006367711B1

(12) United States Patent
Benoist

(10) Patent No.: US 6,367,711 B1
(45) Date of Patent: Apr. 9, 2002

(54) DISMANTABLE DISPENSING HEAD

(75) Inventor: Jean-Francois Benoist, Lagny/Marne (FR)

(73) Assignee: L'Oreal, Paris (FR)

( * ) Notice: Subject to any disclaimer, the term of this patent is extended or adjusted under 35 U.S.C. 154(b) by 0 days.

(21) Appl. No.: 09/472,807

(22) Filed: Dec. 28, 1999

(30) Foreign Application Priority Data

Dec. 29, 1998 (FR) ..... 98 16571

(51) Int. Cl.[7] ..... B05B 15/02

(52) U.S. Cl. ..... 239/115; 239/333; 239/337; 239/526; 239/600

(58) Field of Search ..... 239/333, 337, 239/340, 349, 354, 463, 471, 472, 475, 104, 106, 115, 116, 526, 600; 222/402.1, 402.12, 402.13, 153.11, 556

(56) References Cited

U.S. PATENT DOCUMENTS

| | | | |
|---|---|---|---|
| 2,989,251 A | | 6/1961 | Abplanalp et al. |
| 3,319,894 A | | 5/1967 | Cooprider |
| 4,253,609 A | | 3/1981 | Laauwe |
| 5,213,269 A | | 5/1993 | Srinath et al. |
| 5,743,468 A | * | 4/1998 | Laidler ..... 239/115 |

FOREIGN PATENT DOCUMENTS

| | | |
|---|---|---|
| EP | 0 726 096 A2 | 8/1996 |
| EP | 0 790 079 A2 | 8/1997 |
| FR | 2 698 854 | 6/1994 |

* cited by examiner

*Primary Examiner*—Lisa Ann Douglas
(74) *Attorney, Agent, or Firm*—Oblon, Spivak, McClelland, Maier & Neustadt, P.C.

(57) ABSTRACT

A fluid product dispenser and a dispensing head for a fluid product dispenser are provided. The fluid product dispenser dispenses fluid product in the form of any one of a jet and a spray. The dispensing head includes a body or first piece having an inlet conduit. The inlet conduit communicates with a stem of any one of a pump and valve of the fluid product dispenser. The dispensing head also includes a second piece mounted on the first piece. The first piece includes a dispensing orifice which can be detachably placed in communication with the inlet conduit. The second piece is movable at will, with respect to the body or first piece, in an X-direction, wherein the X-direction is different from a Y-direction defined as the fluid product outlet direction of the jet or spray of the fluid product. The second piece is movable in order to clean the inlet conduit.

17 Claims, 6 Drawing Sheets

DISMANTABLE DISPENSING HEAD

BACKGROUND OF THE INVENTION

1. Field of the Invention

The present invention generally relates to dispensers and more particularly, to a dispensing head for use with a fluid product dispenser, wherein the fluid product dispenser dispenses fluid product in the form of a jet or a spray, and also to a fluid product dispenser having such a dispensing head.

2. Discussion of Background

Generally, a fluid product dispenser includes a reservoir containing the fluid product to be dispensed. The reservoir has an open end. A dispensing member, such as a pump or a valve, is fastened to the open end of the reservoir. A dispensing head is mounted on the dispensing member. The dispensing head performs two functions. First, the dispensing head allows the user to control the actuation of the dispensing member so that the dispensing member ejects a dose of fluid product from the reservoir. Second, the dispensing head makes it possible to convey the fluid product, leaving the reservoir, to a dispensing orifice, such as a nozzle, via an inlet conduit provided in the dispensing head. The dispensing of the fluid product is thereafter carried out either in the form of an approximately filiform jet, or else in the form of a cloud of fine droplets, often referred to as a spray. The fluid product may be conveyed to the dispensing orifice by simply pressing on a compressible product reservoir. When the fluid product dispenser is equipped with a dispensing valve, the reservoir contains a pressurized gas in addition to the fluid product. The pressurized gas is for propelling the fluid product to be dispensed through the dispensing orifice.

A conventional dispensing head, for dispensing a fluid product in the form of a jet or a spray, includes a body having an inlet conduit. The inlet conduit communicates with the product reservoir. The inlet conduit opens outwardly into a dispensing nozzle. The dispensing nozzle has an outlet orifice. The outlet orifice has a small cross section. Ordinarily, such a dispensing nozzle is an add-on piece which is non-detachably fixed to the dispensing head during manufacture.

If the dispensing head becomes blocked due to build up of product residues, it is practically impossible to unblock or clean the nozzle, and/or the inlet conduit, without damaging the dispensing head and without subsequent injury to the operation of the dispenser.

Blockage of the dispensing head may occur fairly frequently, when the fluid product is a solution or a dispersion which dries easily in the open air. Such fluid products are found among atomized glues, paints, and certain cosmetic or dermo-pharmaceutical products, such as hair and skin conditioning products, for instance, hair lacquers or sunscreen products.

U.S. Pat. No. 3,961,756 ("the '756 patent") discloses a spray head comprising a nozzle screwed onto a free end of the fluid product inlet conduit. The '756 patent teaches that the characteristics of the stream of fluid product or spray may be modified by rotation of the nozzle, which displaces the nozzle along the outlet axis of the fluid product jet. In the event of a blockage of the spray head, the nozzle may be dismantled in order to clean the spray head. However, it is still difficult to access the inlet conduits to unblock them when a blockage occurs. Further, once the nozzle is refitted after cleaning, numerous readjustment operations must be performed in order to ensure unchanged quality of spray.

Furthermore, molding of the nozzle, to be screwed into the free end of the fluid product inlet conduit, is difficult or impossible. Thus, the nozzle must be made of metal and then must be machined. The metal and machining both raise the cost of manufacturing the nozzle. Finally, because the nozzle moves along the axis of the jet, it is vital, in order to prevent the nozzle from being expelled under the pressure of the jet, to ensure fastening by a screwing-type link.

A cleanable dispensing head for fluid products is described in WO-A-96/31 412 ("the '412 reference"). The dispensing head of the '412 reference includes a fixed part and a detachable part. Thus, if the dispensing head of the '412 reference becomes blocked, it is possible to access the dispensing orifice and the terminal part of the product inlet conduit, because the detachable part of the dispensing head is separable along a plane passing through the center of the dispensing orifice. If the dispensing orifice is of a particularly small size, a dispensing orifice in which the edge of the outline forms part of two different pieces is a major drawback. More particularly, when the dispensing head has a diameter generally between 0.1 mm and 1.0 mm and the dispensing head is made in two molded pieces, as is the case of the dispensing head of the '412 reference, it is impossible to obtain an even edge for the dispensing orifice because of the presence of a sealing joint. Additionally, the presence of the sealing joint results in an uneven and coarse spray and makes it impossible to obtain an even spray cone with a fine and homogeneous size distribution of droplets.

European patent application publication no. 726 096 ("the '096 reference") describes a spray head having a dispensing orifice which is movable with respect to an annular swirl chamber and to the conduits feeding the dispensing orifice with fluid product. The purpose of the spray head device of the '096 reference is to vary the divergence characteristics of the spray obtained. The swirl chamber and conduits feeding the dispensing orifice with fluid product are not accessible for cleaning.

Other dispensing heads, such as those described in U.S. Pat. Nos. 2,989,251 and 3,319,894, French patent application publication no. 2 698854, and European patent application publication no. 0 790 079, are not dismantable or even temporarily openable for cleaning of the feed conduits therein.

Hence, one of the objectives of the present invention is to provide a dispensing head which is easily cleanable, without the requirement of complicated dismantling.

Yet another objective of the present invention is to provide a dispensing head which is easily refittable after cleaning.

Another objective of the present invention is to provide a dispensing head capable of ensuring the production of an even spray or jet having fine droplets of homogeneous distribution.

Yet another object of the present invention is to provide a dispensing head which is simple to manufacture, preferably by molding, so as to be fairly inexpensive.

SUMMARY OF THE INVENTION

The present invention relates to a dispensing head for use on a fluid product dispenser which dispenses a fluid product in the form of a jet or a spray. The dispensing head includes a body having an inlet conduit. The inlet conduit communicates with a stem of a pump or a valve of the fluid product dispenser. The dispensing head also includes a piece mounted on the body, wherein the piece has a dispensing orifice which can be detachably placed in communication with the inlet conduit.

In accordance with the present invention, the piece is movable at will, with respect to the body, in an X-direction different from a Y-direction, wherein the Y-direction is defined as the outlet direction of the jet or spray of the fluid product. The movement of the piece, with respect to the body, is for cleaning the inlet conduit. An advantage of the present invention is that the pressure exerted by the fluid product on the internal wall of the piece, which is movable and which surrounds the dispensing orifice, cannot modify the position of the dispensing orifice with respect to the body. Another advantage is that after repeated dismantlings and refittings of the dispensing head, the quality of the jet or spray of the fluid product is not impaired over time.

When the fluid product dispenser includes a valve, the fluid product can be conveyed to the valve via a pressurized propellant gas. The pressurized propellant gas may act directly or indirectly on the fluid product contained in a reservoir provided in the fluid product dispenser.

Advantageously, the inlet conduit, which is located opposite of the dispensing orifice, opens outwardly into a swirl chamber. Just before a stream of fluid product passes through the dispensing orifice, the swirl chamber is able to impart a convergent spiral acceleration motion to the stream of fluid product. The application of the convergent spiral acceleration motion to the stream of fluid product makes it possible to break-up the fluid product into particularly fine droplets, after the fluid product has passed through the dispensing orifice. The break-up of the fluid product into particularly fine droplets is especially useful in such cases as when using either a pre-compression pump or a dispensing valve, wherein the dispensing valve is used in combination with a compressed propellant gas which is insoluble in the fluid product.

According to a first embodiment of the present invention, the piece is movable, can be fully detachable, and at least partially shrouds the body. Preferably, the piece is placed in an appropriate position on the dispensing head or else, is dismantled from the dispensing head, via movement along a longitudinal axis which passes through the valve stem or pump stem. Thus, at least a portion of the inlet conduit is delimited, in part by the body and in part by the movable or detachable piece. In other words, a portion of the inlet conduit is defined by a volume delimited between an external surface of the body and an internal surface of the movable or detachable piece.

According to a second embodiment of the present invention, the dispensing orifice is situated on a plane portion of the movable or detachable piece. The plane portion delimits the swirl chamber and cooperates with a portion of the body in such a way as to position the movable or detachable piece at an angle with respect to the body. The portion of the body which cooperates with the plane portion of the piece is a "flat". Thus, constant and reproducible quality of the spray is ensured, even after dismantling and refitting of the dispensing head.

According to a third embodiment of the present invention, the movable or detachable piece articulates with the body via a film hinge. Furthermore, the movable or detachable piece is pivotable. Thus, the dispensing head can be manufactured in a single piece through a single molding operation.

According to a fourth embodiment of the present invention, the movable or detachable piece can be a strip, which has been bent into an "L" shape. A free end of the "L"-shaped strip articulates with the body. The "L"-shaped strip includes an orifice on one of the two portions forming the "L"-shape. Thus, the movable or detachable piece includes two portions. A first portion of the two portions of the movable or detachable piece has the orifice therein. The first portion also has a free end adjacent to the film hinge. A second portion of the two portions of the movable or detachable piece is in leaktight contact with the upper part of the body. Together, the second portion and the body delimit a part of the inlet conduit. Furthermore, the movable or detachable piece may have a snap-fit means for snap-fittingly cooperating with complementary snap-fit means carried on the body. Thus, the movable or detachable piece may be immobilized during the actuation of the dispensing head.

Advantageously, the dispensing head of the present invention has a push-button with a bearing surface. A user of the dispensing head pushes on the bearing surface of the push-button to eject a dose of fluid product.

The present invention also relates to a dispenser, wherein the dispenser includes a reservoir of fluid product. A pump or a valve is mounted on the reservoir and the reservoir is equipped with a dispensing head as has been defined above.

BRIEF DESCRIPTION OF THE DRAWING FIGURES

The appended drawing figures represent exemplary embodiments of the present invention to provide a better understanding thereof, but are not meant to be limiting.

DETAILED DESCRIPTION OF THE PREFERRED EMBODIMENTS

Figure 1:
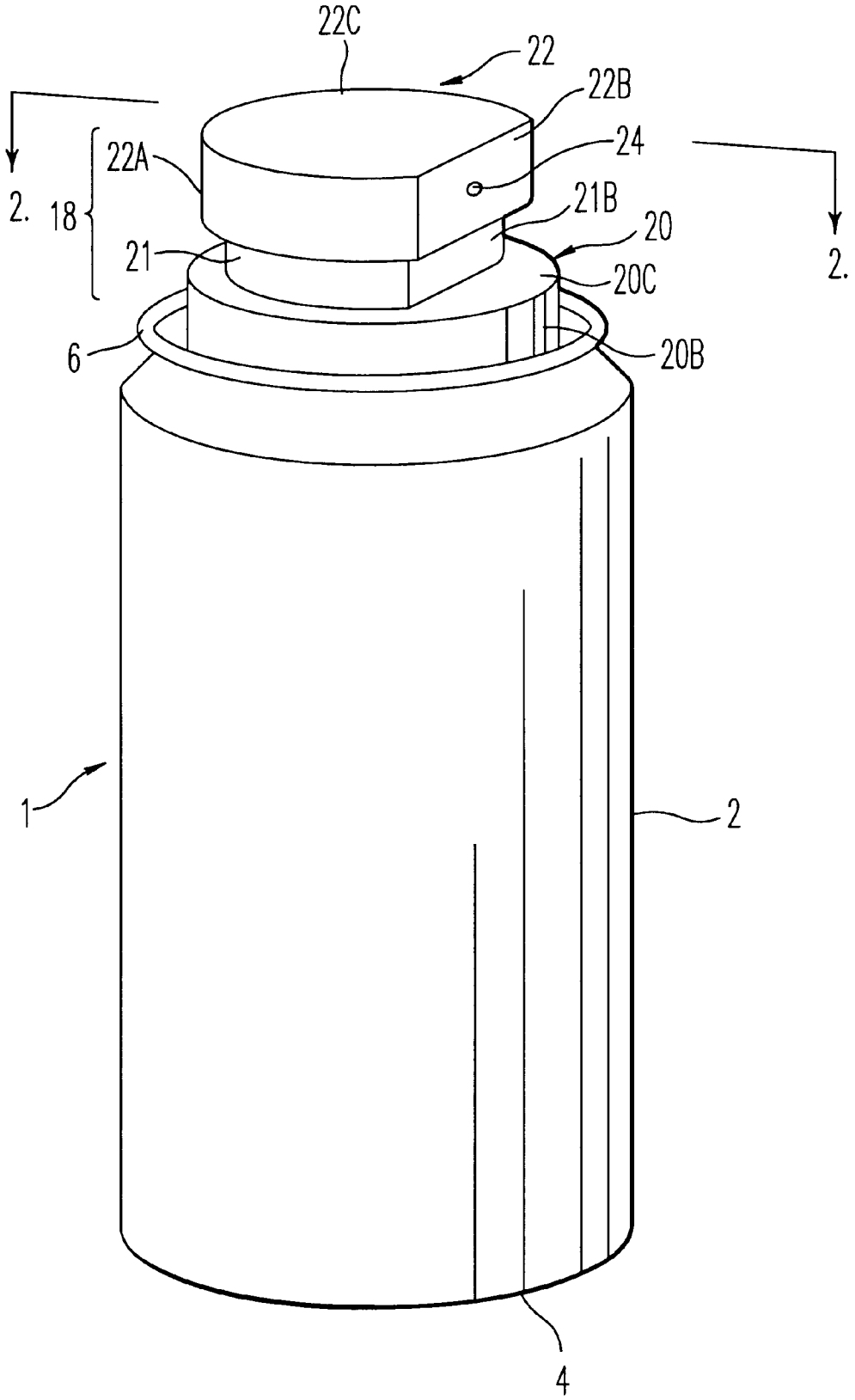
FIG. 1 is a perspective view of a first embodiment of a dispensing assembly of the present invention, wherein the dispensing assembly is equipped with a dispensing head.
Figure 2:
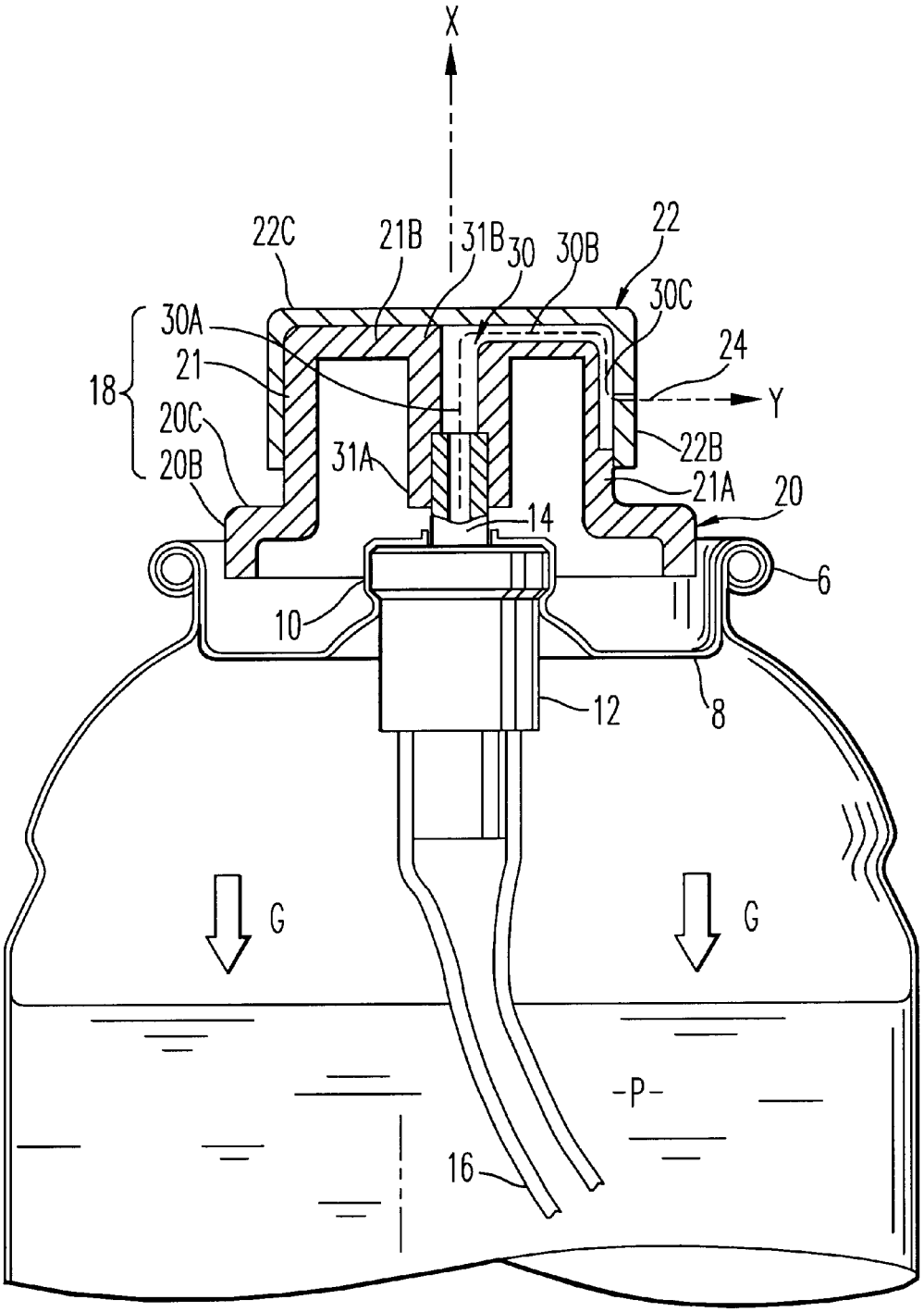
FIG. 2 is a partial, axial cross-sectional view taken along plane II—II of FIG. 1.

Referring to FIGS. 1 and 2, a first embodiment of the dispensing assembly 1 of the present invention is shown. The dispensing assembly 1 includes a cylindrical reservoir 2. The cylindrical reservoir 2 has a central, longitudinal axis X. A liquid or fluid product P, such as a hair lacquer, is packaged in the cylindrical reservoir 2. The reservoir 2 is pressurized with the aid of a propellant gas G. Any gas ordinarily used in the field of atomization, such as liquefiable gases or compressed gases, can be employed as the propellant gas G. However, the dispensing head of the present invention is particularly well suited for atomizing of a fluid product P using a compressed gas, wherein the compressed gas is generally insoluble in the fluid product P.

The first embodiment of the reservoir 2, as illustrated in FIGS. 1 and 2, has a cylindrical body, a closed bottom 4, and a rolled edge 6. The rolled edge 6 defines a circular opening in the top of the reservoir 2. A valve-holder cup 8 is fastened into the circular opening, for example, by crimping or flanging. A cylindrical cavity 10 is formed in the center of the cup 8. A valve 12 is mounted in the cylindrical cavity 10. The valve 12 has a body. A stem 14 extends outwardly from a first end of the body of the valve 12. The stem 14 passes through the center of the cup 8 and the stem 14 has an axis which coincides with the central, longitudinal axis X of the reservoir 2. A dip tube 16 is mounted inside of the reservoir 2 on the second end of the body of the valve 12. The dip tube 16 conveys the fluid product P into the valve 12. The valve 12 may be a male or female push-down type valve. The valve 12 may also be of a type that can be actuated by lateral tilting of the valve stem 14.

The valve stem 14 has a free end. A dispensing head 18 is mounted on the free end of the valve stem 14. The dispensing head 18 is made in two pieces, namely, a first piece 20, which forms the body of the dispensing head 18, and a second piece 22, mounted on the body or first piece 20 of the dispensing head 18. The second piece 22 is made up of a cap and a lateral skirt 22*a*. The lateral skirt 22*a* is generally cylindrical, but has a flat portion 22*b*. The second piece 22 is mounted on the body or first piece 20 of the dispensing head 18 so as to be translatably movable along the central, longitudinal axis X of the reservoir 2. The movable second piece 22 also includes a flat top 22*c* which serves as a bearing surface for the actuation of the valve 12. The flat portion 22*b* has an emergent orifice 24 at a center thereof. The emergent orifice 24 constitutes a spray nozzle. The emergent orifice or spray nozzle 24 is formed by drilling a cylindrical opening with a diameter ranging from approximately 0.15 mm to approximately 1 mm. The depth of the emergent orifice or spray nozzle 24 is approximately 0.1 mm to approximately 1 mm so that the emergent orifice or spray nozzle 24 may define the cross section of the liquid jet or spray of the fluid product P.

The body or first piece 20 includes a base 20*a*. The base 20*a* includes a cylindrical skirt 20*b* which has been bent backwardly to form a plate 20*c*. A generally cylindrical portion 21 is arranged on the plate 20*c*. The cylindrical portion 21 has an outer diameter which is less than the diameter of the skirt 20*b* and which substantially corresponds to the internal diameter of the lateral skirt 22*a* so that there is enough clearance to ensure the axial displacement of the movable second piece 22 on the cylindrical portion 21 of the body or first piece 20. The cylindrical portion 21 includes a flat portion 21*a*. The flat portion 21*a* bears against the internal face of the flat portion 22*b* of the detachable piece 22 so as to form a leaktight contact. Thus, accurate and reproducible angular positioning of the nozzle 24 can be ensured with respect to the body or first piece 20. The top of the body or first piece 20 is a closed plate 21*b*.

The body or first piece 20 is provided with a conveying system for bringing the fluid product P, to be dispensed from the valve stem 14, to the emergent orifice or spray nozzle 24. For this purpose, an inlet conduit 30 includes a central duct 30*a*. The central duct 30*a* has a free end 31*a* which fits on the valve stem 14 in a leaktight manner. The opposite end 31*b* of the central duct 30*a* extends outwardly from the center of the plate 21*b* into a radial slot 30*b*. The radial slot 30*b* extends to the periphery of the plate 21*b*. A channel 30*c*, which extends so as to be aligned with the radial slot 30*b*, has been hollowed out in the front face of the flat portion 21*a*. The channel 30*c* opens outwardly into a swirl chamber 32. The swirl chamber 32 has a substantially cylindrical cross section and has also been hollowed out in the front face of the flat portion 21*a*. The depths of the radial slot 30*b* and of the channel 30*c* are on the order of approximately 0.4 mm to approximately 3.0 mm. The swirl chamber 32 is not very deep, for example, on the order of approximately 0.1 mm to approximately 1.0 mm. An inlet conduit 30 is defined by the duct 30*a*, the radial slot 30*b*, and the channel 30*c*, in combination with the movable second piece 22, when the movable second piece 22 is mounted on the body or first piece 20 of the dispensing head 18. The inlet conduit 30 is for conveying the fluid product P which is discharged after actuating the valve 12.

Figure 3:
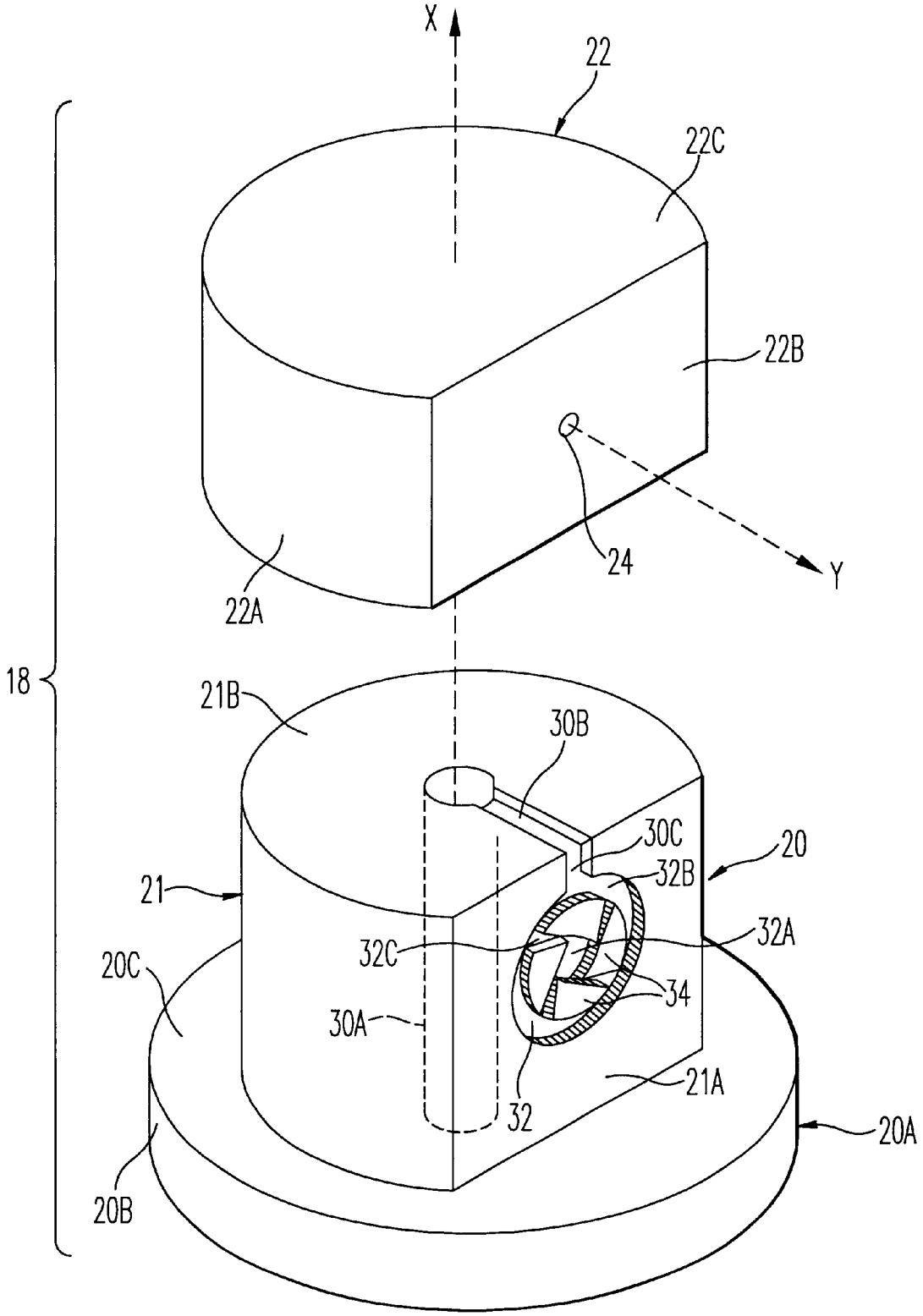
FIG. 3 is an exploded, enlarged perspective view of the dispensing head of FIGS. 1 and 2.

Referring to FIG. 3, the bottom of the swirl chamber 32 includes profiles 34. The height of each of the profiles 34 corresponds to the depth of the swirl chamber 32. The profiles 34 are capable of imparting a spiral motion to the stream of fluid product P conveyed by the inlet conduit 30. The spiral motion converges towards the center 32*a* of the swirl chamber 32, opposite the emergent orifice or spray nozzle 24, when the movable second piece 22 is mounted on the body or first piece 20. Specifically, the fluid product P is conveyed via the inlet conduit 30. The inlet conduit is made up of portions 30*a*–30*c*. The inlet conduit 30 enters a circular passage 32*b* of the swirl chamber 32, which is defined between the external edges of the profiles 34 and the external peripheral edge of the swirl chamber 32. Passages 32*c* are made between the profiles 34 and the passages 32*c* have decreasing cross sections for conducting the fluid product P towards the center 32*a* of the swirl chamber 32, while entraining the fluid product P in a vortex rotating about an central, longitudinal axis Y of the emergent orifice or spray nozzle 24. The central, longitudinal axis Y is a product outlet axis and is substantially perpendicular to the central, longitudinal axis X of the reservoir 2. The decreasing cross-sections of the passages 32*c* form convergent sections. The velocity of the stream of fluid product P is accelerated through the convergent sections of the passages 32*c*. The accelerating velocity of the stream of fluid product P promotes the break-up of the fluid product P into fine droplets, after the fluid product P has passed through the emergent orifice or spray nozzle 24. The use of such a swirl chamber 32 is particularly suitable for atomizing a fluid product P which is pressurized in the reservoir 2 by a propellant gas which is insoluble in the fluid product P. Examples of propellent gases which is insoluble in the fluid product P are compressed gases, such as $CO_2$, nitrogen, and compressed air.

A dose of fluid product P may be dispensed in any conventional manner. More specifically, when the dispensing valve 12 is a push-down valve, the valve 12 can be actuated by simply pressing on the upper surface 22*c* of the dispensing head 18. Where the dispensing valve 12 is a lateral tilt valve, the valve 12 is actuated by pressing laterally on the dispensing head 18.

Blockage may occur in the dispensing head 18 at two levels. A first level of blockage may occur at the emergent orifice or spray nozzle 24. Blockage at the emergent orifice or spray nozzle 24 may be due to residues of dried product building up after a prolonged period of non-use of the dispensing assembly 1. A second level of blockage may occur in the inlet conduits 30. When blockage at either the first or second level occurs, it is necessary to clean the dispensing head 18. To clean the dispensing head 18, the user holds the base 20*a* of the body or first piece 20 in place with the fingers of one hand. The user of the dispensing assembly 1 grasps the movable second piece 22 with the fingers of the other hand and removes the movable second piece 22 by pulling axially along the central, longitudinal axis X of the reservoir 2. The body or first piece 20, now separated from the movable second piece 22, may be cleaned under the tap or faucet.

After rinsing and drying the body or first piece 20 and the movable second piece 22, the movable second piece 22 is repositioned on the cylindrical portion 21 of the body or first piece 20. The angular positioning of the emergent orifice or spray nozzle 24 with respect to the swirl chamber 32 is accomplished because of the presence of the flat portions 21*a*, 21*b*. It should be noted that the construction of the dispensing head 18, according to the present invention, allows for correct repositioning of the emergent orifice or spray nozzle 24, after cleaning. The correct repositioning of the emergent orifice or spray nozzle 24 occurs because the pressure of the fluid product P exerted on the wall of the movable second piece 22 surrounding the emergent orifice or spray nozzle 24 cannot modify the position of the emergent orifice or spray nozzle 24. This is because the direction of thrust of the fluid product P is along the product outlet axis Y, i.e., perpendicular to the direction of movement of the movable second piece 22 with respect to the body or first piece 20.

Figure 4:
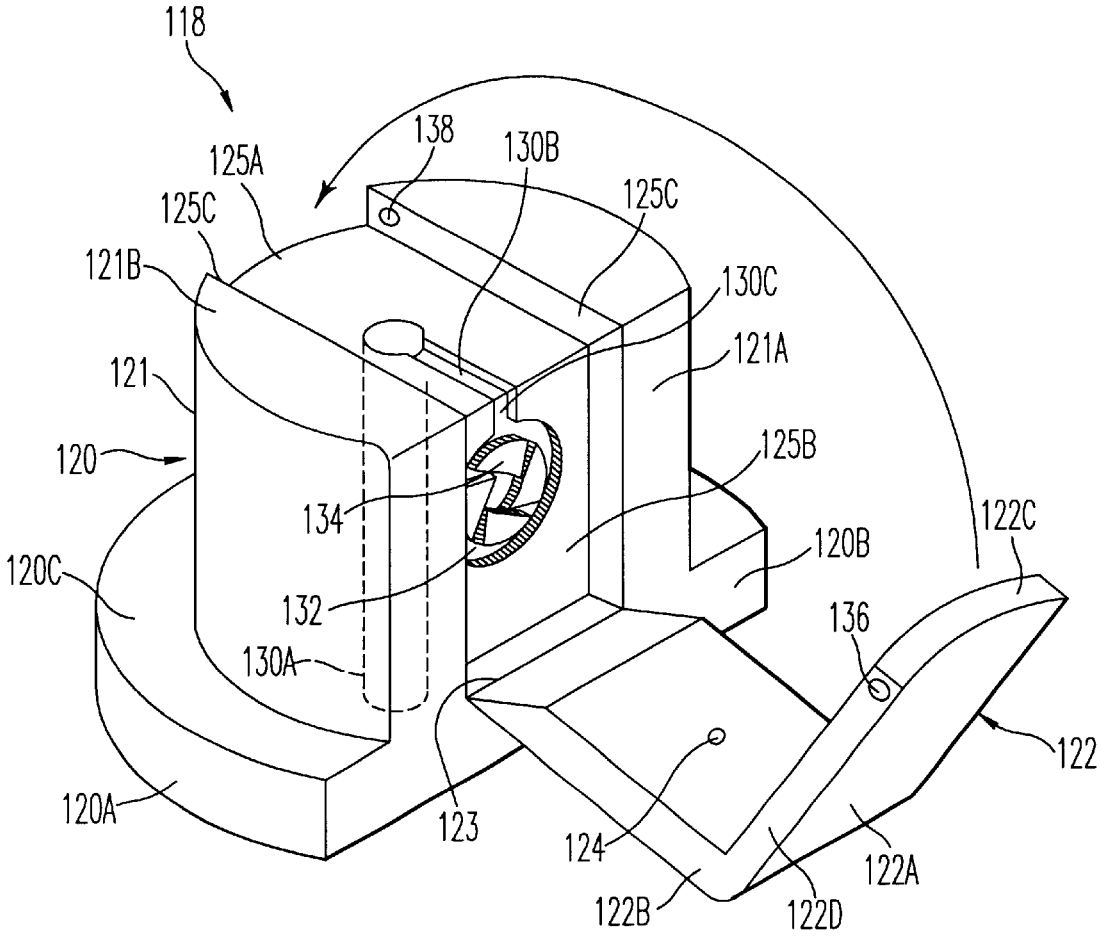
FIG. 4 is an enlarged perspective view of a second embodiment of the dispensing head.

FIG. 4 illustrates a second embodiment of a dispensing head 118. The second embodiment is different from the first embodiment in that the dispensing head 118 is a single piece.

Those parts of the second embodiment of the dispensing head 118, which are the same as or play a similar role to the parts of the first embodiment of the dispensing head 18 described above, have similar reference numerals, except have been increased by 100.

The dispensing head 118 includes a base 120*a*. The base 120*a* is generally cylindrically shaped and has a flat portion 120*b*. The base 120*a* includes a plate 120*c*. A cylindrical portion 121 has a smaller diameter than the diameter of the base 120*a*. The cylindrical portion 121 is mounted on the plate 120*c*. The cylindrical portion 121 is provided with a lateral flat portion 121*a*. The lateral flat portion 121*a* is arranged in the same plane as the flat portion 120*b* of the base 120*a*. The cylindrical portion 121 is furnished with a flat top 121*b*.

A film hinge 123 is located in the central part of the flat portion 120*b* of the base 120*a*. The film hinge 123 connects the body or first piece 120 to a movable second piece 122. The first piece 120 and the movable second piece 122 form a substantially "L"-shaped strip. Thus, the film hinge 123 is adjacent to a first parallelpipedal portion 122*b* of the "L"-shaped strip. The first parallelpipedal portion 122*b* is bent back at a right angle and the film hinge 123 forms the second portion 122*a* of the "L"-shaped strip.

The flat portion 121*a* of the body or first piece 120 includes a depression 125*b*. After pivoting the movable piece 122, the depression 125*b* is able to receive the first parallelpipedal portion 122*b*. The flat top 121*b* of the body or first piece 120 also includes a depression 125*a* which is able to receive the second portion 122*a* of the movable second piece 122. Additionally, the lateral edges 125*c* include snap-fit means 138 for snap-fittingly cooperating with complementary snap-fit means 136 carried by the lateral edges 122*d* of the movable second piece 122.

In a similar manner to the first embodiment of FIGS. 1 to 3, the body or first piece 120 includes an inlet conduit 130 made of a first part 130*a*, a second part 130*b*, and a third part 130*c*. The first, second, and third parts 130*a*, 130*b*, 130*c* open outwardly into a swirl chamber 132. Profiles 134 are included in the swirl chamber 132 in such a way that a conveyed stream of the fluid product P undergoes a swirl motion. When the movable second piece 122 is in a closed position so as to be correctly lodged in the recesses 125*a*, 125*b*, the inlet conduit 130 conveys the fluid product P, carried in the swirl chamber 132, to an emergent orifice or a spray nozzle 124. The emergent orifice or spray nozzle 124 is made in the first portion 122*b* of the movable second piece 122.

To clean the dispensing head 118 when a blockage occurs, the user of the dispensing assembly pulls on a free end 122*c* of the movable second piece 122 so as to pivot the entire movable second piece 122 about the axis of the film hinge 123. Thus, the first, second, and third parts 130*a*, 130*b*, 130*c* of the inlet conduit 130, the swirl chamber 132, and the emergent orifice or spray nozzle 124 all become accessible so that the dry residues of fluid product P or the particles which caused the blockage can be removed by rinsing of the parts which are now accessible.

Figure 5:
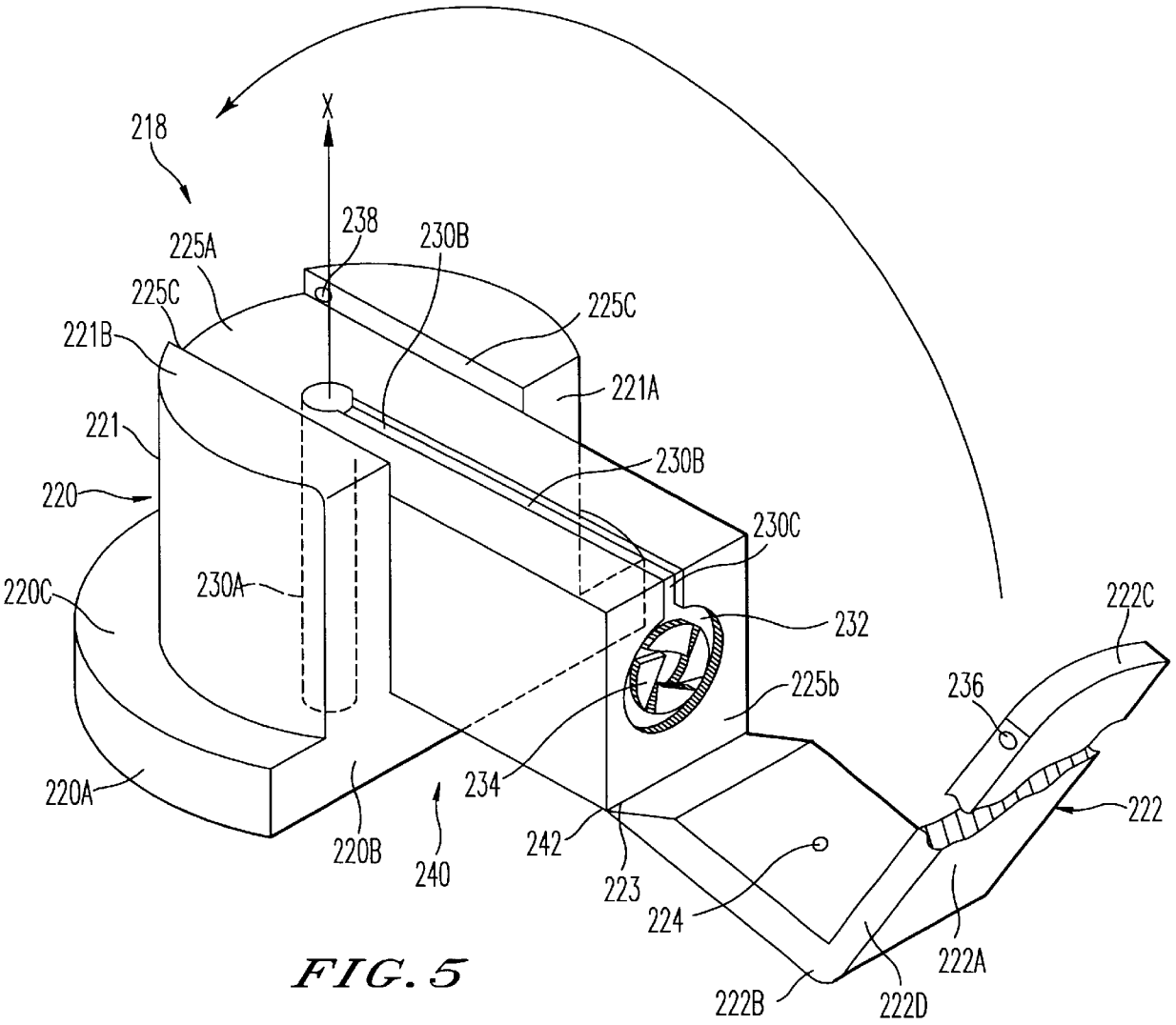
FIG. 5 is a perspective view of a third embodiment of the dispensing head.

FIG. 5 illustrates a third embodiment of a dispensing head 218. The third embodiment of the dispensing head 218 differs from the second embodiment of the dispensing head 118, shown in FIG. 4, in the shape of the emergent orifice or spray nozzle 224. The emergent orifice or spray nozzle 224 is situated on a spout 240 and emerges radially to allow for particularly targeted application of the fluid product P at the location to be treated.

Those parts of the third embodiment of the dispensing head 218 which are similar or play a similar role to the parts of the second embodiment of the dispensing head 118 described above have the same reference numerals, except have been increased by 100. Only a partial description of these parts will be repeated as is considered necessary.

Referring to FIG. 5, a spout 240 constitutes a parallelepipedal-shaped extension of the support of the swirl chamber 232. The upper face 225*a* of the spout 240 comprises a portion 230*b* of the inlet conduit. Thus, a free end of the spout 240 consists of a front face 225*b* which is oriented parallel to the central, longitudinal axis X of the reservoir and which passes through the valve stem. The swirl chamber 232 and a portion 230*c* of the inlet conduit have been hollowed out in the front face 225*b* of the spout 240.

A closure member or movable second piece 222 is pivotably mounted on the front face of the spout 240. The closure member or movable second piece 222 articulates along an edge 242 of the front face 225*b* of the spout 240 via a film hinge 223. The structure and manner of operation of the closure member or movable second piece 222 are similar to the structure and manner of operation of the movable second piece 122 illustrated in FIG. 4.

Figure 6:
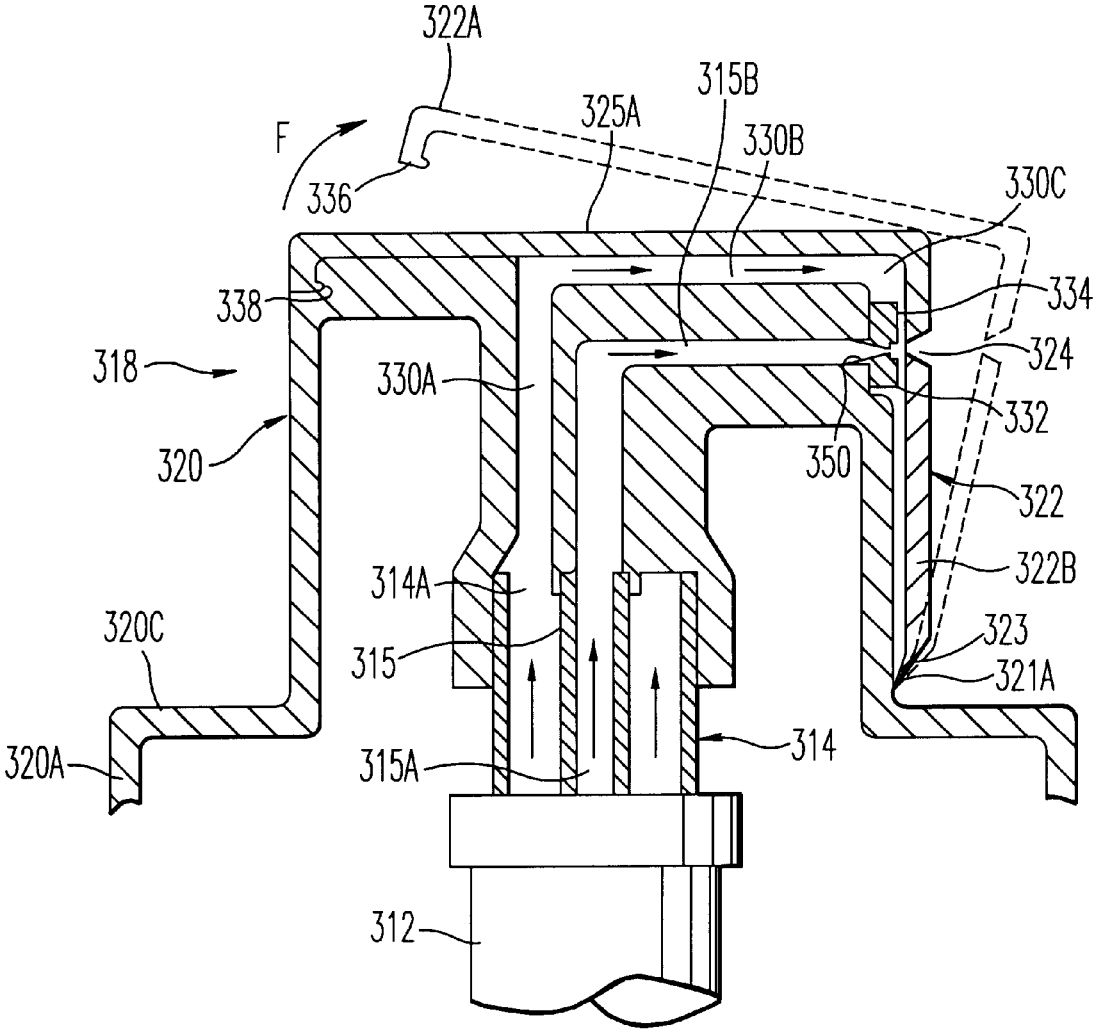
FIG. 6 is an axial cross-sectional view of a fourth embodiment of the dispensing head.

FIG. 6 illustrates a fourth embodiment of a dispensing head 318 of the present invention, wherein the dispensing head 318 includes a spray system of the "venturi" type. The fourth embodiment of the dispensing head 318 differs from the second embodiment of the dispensing head 118 shown in FIG. 4 by means of a double conduit which provides for separate inlet of propellant gas and of fluid product P to the emergerit orifice or spray nozzle 224. This arrangement allows particularly fine atomization of the fluid product P.

Those parts of the fourth embodiment of dispensing head 318 which are similar or play a similar role to the parts of the second embodiment of dispensing head 118 have the similar reference numerals, except have been increased by 200. A description of those parts will be repeated only partially, as necessary.

Referring to FIG. 6, the dispensing valve 312 has a control stem 314 with two separate concentric conduits. A first central conduit 315*a* is formed by an interior duct 315. The first control conduit 315*a* is intended to convey the propellant gas G to the emergent orifice or spray nozzle 324 via an inlet channel 315*b*. The inlet channel 315*b* opens outwardly into a reducer 350 in proximity to the emergent orifice or spray nozzle 324. This is intended to increase the pressure of the propellant gas G before passing through the emergent orifice or spray nozzle 324. This is also intended to suck up the fluid product P.

The fluid product P is conveyed from the valve 312 by an exterior conduit 314*a* of the valve stem 314. An axial channel 330*a* conducts the fluid product P into a portion of a radial conduit 330*b*. The radial conduit 330*b* opens outwardly via a portion 330*c* into the swirl chamber 332. A mixture of propellant gas G and fluid product P is formed at the center of the swirl chamber 332. Under pressure, this mixture of propellant gas G and the fluid product P is directed to the exterior through the emergent orifice or spray nozzle 324. The swirl chamber 332 and the portions 330*b* and 330*c* of the inlet conduit are outwardly delimited by a movable closure member or movable second piece 322. The movable closure member or movable second piece 322 functions and is structured similarly to movable second pieces 122 and 222 of FIGS. 4 and 5, respectively. More specifically, movable closure member or movable second piece 322 has an "L"-shaped structure. A first portion 322*b* of the "L"-shaped structure of movable closure member 322 articulates with a plane surface 321*a* of the dispensing head 318 via a film hinge 323. The emergent orifice or spray nozzle 324 extends through this first portion 322*b*. A second portion 322*a* of the "L-shaped structure of the movable closure member or movable second piece 322 has a free end, wherein the free end forms a fastening catch 336. When in a closure position, the fastening catch 336 cooperates with a complementary cavity 338 made on the opposite side of the emergent orifice or spray nozzle 324. After disengaging the fastening catch 336, the movable closure member or movable second piece 322 can be tilted in the direction of the arrow F. The swirl chamber 332 and part of the feed conduits 330*b* and 330*c* then become accessible for cleaning out thereof. The reducer 350 may also be mounted in a detachable manner for cleaning.

Particular embodiments of the present invention were described in detail above. It is obvious that variants may be made thereto without departing from the spirit of the present invention as will be claimed hereinbelow.

Thus, a first embodiment of a dispensing head comprises a detachable or movable second piece, wherein the second piece has a spray nozzle and two parallel edges, and the second piece is mounted in notches in the upper face of the body or first piece in order to be slidable therein.

According to another embodiment, the emergent orifice or spray nozzle may be situated on a movable second piece capable of slidingly entering guidance means mounted on a face constituted by a flat portion of a first piece, similar to the body or first piece of the first embodiment described above.

Regardless of the embodiment, means may be provided so as to ensure against leaks between the inlet conduit and the swirl chamber, and between the body or first piece and the movable second piece. Such means for preventing leaks may be embodied in the form of a bead or a bead/groove system.

I claim:

1. A dispensing head for a fluid product dispenser which dispenses any one of a jet and a spray of fluid product, said dispensing head comprising:

a first piece delimiting at least in part an inlet conduit adapted to communicate with a stem of any one of a pump and a valve of said fluid product dispenser;

a second piece mounted on said first piece so as to be movable to expose the inlet conduit for cleaning, wherein said second piece includes a dispensing orifice, which dispensing orifice is located entirely in said second piece and can be placed, in a detachable manner, in communication with said inlet conduit of said first piece, and wherein said second piece is movable with respect to said first piece, in an X-direction different from a Y-direction, said Y-direction being an outlet direction of any one of the jet and the spray of fluid product to clean said inlet conduit.

2. The dispensing head according to claim 1, wherein said inlet conduit is located opposite said dispensing orifice and opens outwardly into a swirl chamber.

3. The dispensing head according to claim 1, wherein said second piece at least partially shrouds said first piece.

4. The dispensing head according to claim 1, wherein a portion of said inlet conduit is delimited by both said first piece and said second piece.

5. The dispensing head according to claim 2, wherein said dispensing orifice is situated on a plane portion of said second piece such that said plane portion of said second piece closes said swirl chamber and cooperates with a flat portion of said first piece to determine an angular position of said second piece with respect to said first piece.

6. The dispensing head according to claim 1, wherein said second piece is movable along an axis passing through the stem of said first piece.

7. The dispensing head according to claim 1, wherein said second piece articulates with said first piece and wherein said second piece is pivotable.

8. The dispensing head according to claim 1, wherein said dispensing head is shaped as a pushbutton.

9. The dispensing head according to claim 1, wherein said second piece is an "L"-shaped strip such that a first end of said "L"-shaped strip articulates with said first piece and said dispensing orifice is located in a portion of said "L"-shaped strip.

10. The dispensing head according to claim 9, wherein said second piece includes first and second portions, said first portion comprising said dispensing orifice, and having a free end which is adjacent to said film hinge, and said second portion being in contact with an upper part of said first piece, to delimit a part of said inlet conduit.

11. The dispensing head according to claim 9, wherein said second piece has snap-fit means for snap-fittingly cooperating with complementary snap-fit means mounted on said first piece.

12. A dispensing head for a fluid product dispenser which dispenses any one of a jet and a spray of fluid product, said dispensing head comprising:

a first piece delimiting at least in part an inlet conduit adapted to communicate with a stem of any one of a pump and a valve of a fluid product dispenser;

a second piece mounted on said first piece, wherein said second piece includes a dispensing orifice, which dispensing orifice is located entirely in said second piece and can be placed in communication with said inlet conduit of said first piece, wherein said second piece articulates with said first piece and wherein said second piece is pivotable via a film hinge.

13. A fluid product dispenser for dispensing fluid product, said fluid product dispenser comprising:

a reservoir of fluid product;

any one of a pump and a valve mounted on said reservoir; and a dispensing head including a first piece delimiting at least in part an inlet conduit communicating with a stem of said any one of said pump and said valve, a second piece mounted on said first piece so as to be movable to expose the inlet conduit for cleaning, said second piece including a dispensing orifice, which dispensing orifice is located entirely in said second piece and can be detachably placed in communication with said inlet conduit of said first piece and said second piece being movable with respect to said first piece in a first direction different from a second direction defined as a fluid product outlet direction of any one of a jet and a spray of fluid product being dispensed from said fluid product dispenser in order to clean said inlet conduit of said first piece.

14. A dispensing head for a fluid product dispenser which dispenses any one of a jet and a spray of fluid product, said dispensing head comprising:

a first piece delimiting at least in part an inlet conduit adapted to communicate with a stem of any one of a pump and a valve of a fluid product dispenser;

a second piece mounted on said first piece so as to be movable to expose the inlet conduit for cleaning, wherein said second piece includes a dispensing orifice, which dispensing orifice is located entirely in said second piece and can be placed in communication with said inlet conduit of said first piece.

15. The dispensing head of claim 14, wherein said inlet conduit includes a portion engaging the stem of said any one of said pump and said valve, wherein said second piece is mounted on said first piece so as to be movable to expose the portion of the inlet conduit extending in the direction of the stem of said any one of said pump and said valve.

16. A fluid product dispenser for dispensing fluid product, said fluid product dispenser comprising:

a reservoir of fluid product;

any one of a pump and a valve mounted on said reservoir; and a dispensing head including a first piece delimiting at least in part an inlet conduit communicating with a stem of said any one of said pump and said valve, a second piece mounted on said first piece so as to be movable to expose the inlet conduit for cleaning, said second piece including a dispensing orifice, which dispensing orifice is located entirely in said second piece and can be detachably placed in communication with said inlet conduit of said first piece.

17. The fluid product dispenser of claim 16, wherein said inlet conduit includes a portion engaging the stem of said any one of said pump and said valve, wherein said second piece is mounted on said first piece so as to be movable to expose the portion of the inlet conduit extending in the direction of the stem of said any one of said pump and said valve.

* * * * *